US006625088B1

(12) United States Patent
Mah et al.

(10) Patent No.: US 6,625,088 B1
(45) Date of Patent: Sep. 23, 2003

(54) PIN DISPLAY DEVICE

(75) Inventors: Pat Y. Mah, Hong Kong (CN); Robert Bruce Tiller, Sydney (AU)

(73) Assignee: Daka Development Ltd. (Hong Kong Corporation), Hong Kong (CN)

( * ) Notice: Subject to any disclaimer, the term of this patent is extended or adjusted under 35 U.S.C. 154(b) by 0 days.

(21) Appl. No.: 10/206,711

(22) Filed: Jul. 26, 2002

(51) Int. Cl.[7] ..... G04B 19/00; G04B 25/00; G09F 3/00

(52) U.S. Cl. ..... 368/76; 368/230; 40/446

(58) Field of Search ..... 368/62, 76, 223, 368/230; 40/446–447, 450

(56) References Cited

U.S. PATENT DOCUMENTS 3,593,515 A * 7/1971 Schockner et al. ..... 368/76
4,654,989 A * 4/1987 Fleming ..... 40/427
5,311,487 A * 5/1994 Mininni et al. ..... 368/230
5,494,445 A * 2/1996 Sekiguchi et al. ..... 434/365
6,189,246 B1 * 2/2001 Gorthala ..... 40/446

* cited by examiner

*Primary Examiner*—David Martin
*Assistant Examiner*—Michael L. Lindinger
(74) *Attorney, Agent, or Firm*—Curtis L. Harrington

(57) ABSTRACT

A pin display first embodiment utilizes a cammed two differently dimensioned cam to press a pin support forward to make it even or clear it, followed by a flattened portion to enable a pin support to move back into gentle contact with a belt having raised numerals which generally advance based upon a continuously driven motor. A third position on the cam brings the pin support forward to a third, rest position away from the belt and at which the mechanism rests, typically for one minute. The subject matter can be time, temperature, barometric pressure, or for symbols and pictures for a story telling application. The device can be configured to display any dimensional image and can present a sequence of images. A pin display of a second embodiment of the invention utilizes push-pull solenoids to control pre-specified segmented areas of pins to an outward or inward position.

11 Claims, 4 Drawing Sheets

PIN DISPLAY DEVICE

FIELD OF THE INVENTION

The present invention relates to improvements in the technology relating to inexpensive, novel and reliable clocks and the like for operating a display in a novel pin push format.

BACKGROUND OF THE INVENTION

Chronometers are well known. Pin matrix art devices have been both toy and art for decades, used by children to capture and "digitize" in terms of the position of a limited number of pin heads, an object over which the pins were placed to operate by gravity, falling onto the bottom design shape. The very thing which makes the pin art boxes so much fun, that of utilizing nothing more than the gravity of the pin operating against a surface configuration, also makes it somewhat limiting in that the device must generally be able to be inverted in order to be reset and to be re-oriented to allow the pins to fall.

What is needed is a device which can combine the captivating two dimensional "digitized" effects of pin art and utilize it to operate a clock to show time in the pin art format.

SUMMARY OF THE INVENTION

The pin display mechanism can be utilized as a display clock or any other type of display, such as temperature, barometric pressure, or non alpha numeric displays. A first embodiment of the present invention utilizes a cammed two differently dimensioned cam to press a pin support forward to make it even or clear it, followed by a flattened portion to enable a pin support to move back into gentle contact with a belt having raised numerals which generally advance based upon a continuously driven motor. A third position on the cam brings the pin support forward to a third, rest position away from the belt and at which the mechanism rests, typically for one minute.

Although time could be recorded to seconds, the cycle time for the mechanism to erase, move back to the belt to pick up the new image and then move to a display position could be as little as a second, and is not expected to be accomplished at the time level of seconds. In addition, since each change is accompanied by mechanically controlled movement of the pin holder, or pin matrix, continuous motion is not necessarily desired.

A clock (mounted or free standing)as the image mechanism can be split into one or many independent belts, chains, links, drums, or wheels and more, leading to multiple images being presented at different times. In the clock application showing hours and minutes, it is preferable to utilize four belts with 0–9 digits turns via a clock mechanism. The clock mechanism is preferably a slow moving belt mechanism using rpm step-down or other suitable timing mechanism which may enables a direct drive motor to be employed to move a belt having physically raised numbers forming a volumetric protrusion in the direction of the pin matrix. The time is displayed via the numbers, the pin matrix moves in to the image to present the time as a contour of pins to the outside of the mechanism. It is also possible to move the pin mechanism in and out at different speeds to create a pulsing of image display. The chronometer device can take any external form, can be controlled electronically or mechanically.

The invention also has a story telling application. The device can be configured to display any dimensional image and can present a sequence of images. This could be applied to telling stories or displaying any sequence of images that the user might like to have displayed. The device could be configured to allow the user to insert any 3 dimensional object leading to that object being displayed as a contour map. Further, the device could be configured to display temperature, and become a weather station indicator. In another configuration, a series of electromagnetic actuators can be used to-drive the pins forward and back to create a physical display image.

The pin display clock of a second embodiment of the invention utilizes push-pull solenoids to control pre-specified segmented areas of pins to an outward or inward position. The segmented areas of the pins combine to form numbers in a similar way in which light pixels are combined to indicate numbers.

The pins can be of any size, but the utilization of the segmented areas enables each numeric representation to be actuated with only seven push-pull solenoids. Depending upon the size of the pins and push-pull solenoids, each pin could be actuated to form more complex pictures. The use of segmented areas and common or simultaneous pin contact enables a reduction in the number of actuators. The use of solenoids enables the time to be instantly changed or changed in sequence, solenoid by solenoid, for a more entertaining display. Preferably the solenoids are latched solenoids which work like a pen mechanism. One actuation pushes the pins forward and a second actuation causes the pins to spring back.

A second embodiment features a display device which is shown as a display chronometer for illustration purposes only. The second embodiment also has a flat clear display in front of a decorative pin hole array supported by four tubular standoffs. An array of apertures enable the decorative pin hole array to present a series of pins extending through the decorative pin hole array including a series of fixed pins as well as a series of actuatable pins which are actuatable in groups to form a numeric (or other) display.

A fixed pin plate includes a series of either holes or whole missing sections to enable a series of pin support segments to be expressed through the holes or whole missing sections based upon a mechanical connection to a series of solenoids. Solenoids are arranged into a cluster to support a pattern capable of being selectively actuated to express a symbol.

The cluster of solenoids are supported by a circuit board and each have an actuator supporting a plate. Each plate supports a grouping of actuatable pins. The expression of the actuatable pins can be had by either pulling them to a position behind the maximum forward extent of the series of fixed pins, or by pushing them to a forward extent beyond the maximum forward extent of the series of fixed pins.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
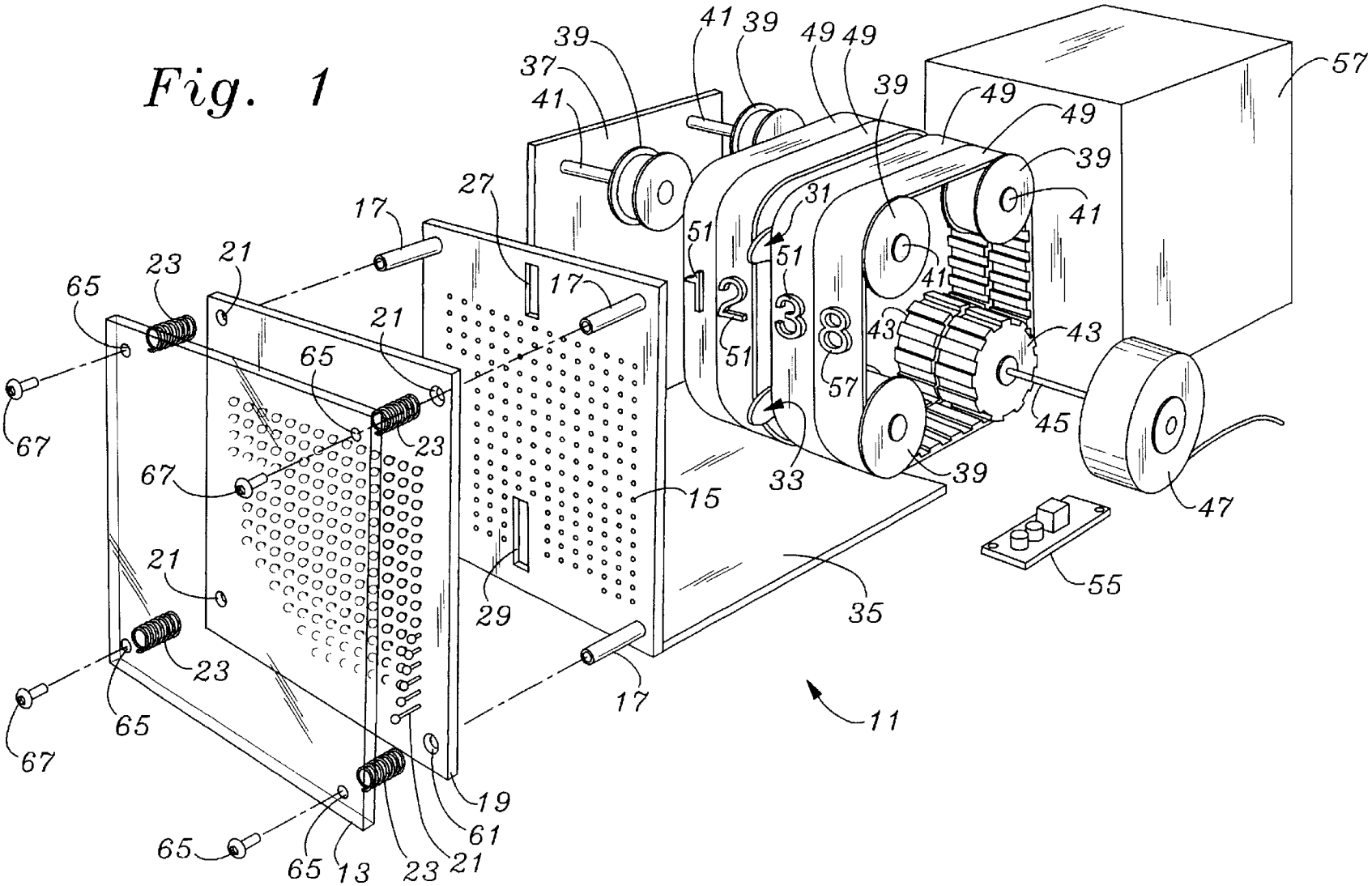
FIG. 1 is a perspective view of the chronometer of the present invention.

The description and operation of the invention will be best initiated with reference to FIG. 1, beginning at the left. A display chronometer 11 has a front flat clear display 13 supported a generally fixed distance away from a pin hole array 15. A series of four tubular standoffs 17 fix the distance between the pin matrix or pin support 15 and the flat clear display 13. Between the pin support 15 and the flat clear display 13, a pin matrix support 19 is mounted to slide along the tubular standoffs 17 by use of a series of four bores or apertures 21. The pin matrix support 19 is biased in a direction toward the pin hole array 15 by the use of four springs 23 which urge against the display 13 and in the direction of the pin hole array 15.

Pin hole array 15 has a pair of spaced apart cam slots 27 and 29 through which cam members 31 and 33 can actuate against the actuated the pin matrix support 17 evenly to perform the resetting action. The pin hole array 15 is connected to a base 35. Base 35 may be attached to a side wall support 37 an opposite side wall is removed for clarity. Side wall 37 supports a series of roller drum supports 39, typically on a series of axles 41 which may extend from the side wall support 37. Rather than rollers drum supports 39, the lower rear location is occupied by a series of sprockets 43. Sprockets 43 are engaged by a shaft 45 which is driven by a motor 47. Sprockets 43 and rollers drum supports 39 support a series of belts 49 which support a series or protruding numbers 51. The sprockets 43 may include reduction gears in order that certain of the belts 49 turn more slowly than others to register the time in minutes and hours. The belts 49 indicating the hour may be combined as a single belt for a twelve hour indication or may operate separately for a twenty four hour operation.

Motor 47 may have a connection to either an alternating current source or to a battery or solar power source. A switch set 55 may be used to control the cams 31 and 33 or other controls as are necessary. For example, where a user wants a time change only every five minutes, the cams 31 and 33 could be set to operate only once every five minutes. Even though the belts 49 continue to turn, their image would be captured only every five minutes, for example. The timing of the image capture could be performed in accord with the alignment of the protruding numbers 51. Also seen is a covering box 57 which may provide viewing for the pin array.

The pin matrix support 19 may be somewhat wider than pin hole array 15 in order that forward movement of the pin matrix support 19 may bring a series of pins 61, having heads 63, forward once pin matrix support 19 is moved away from the pin hole array 15 after an impression of the protruding numbers 51 is had. This could also be accomplished by selection of materials, selecting the pin matrix support 19 with either a more frictional material or smaller sized holes to provide some interference, or conversely selecting the pin hole array 15 to have a virtually frictionless material. In any event, it is the pin matrix support 19 which should dominate as far as friction is concerned. Further, once the pins 61 are loaded into place, the pins 61 will remain vertical due to their being supported in at least two places. Pins 61 having a friction coating in the vicinity of the pin matrix support 19 will assist in allowing the pin matrix support 19 to dominate in the frictional engagement of the pins 61.

Also seen are apertures 65 in the flat clear display 13 to enable threaded members 67 to engage the threaded interiors of the four tubular standoffs 17.

Figure 2:
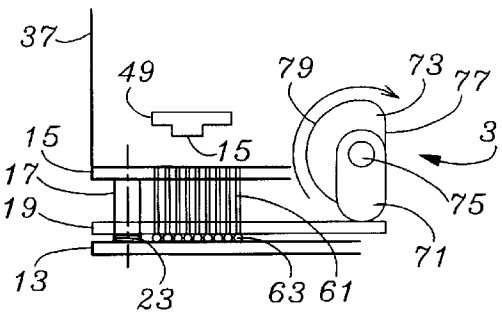
FIG. 2 is a schematic view of a portion of the pins and cam member seen in FIG. 1 illustrating a far push cam action which clears any image of the pin heads by compression against a front flat display.

FIG. 2 is a schematic view of a portion of the pins 61 and cam member 31. The view is not taken with respect to any particular orientation, but simply shows the pin hole array 15 supported by side wall support 37, a single tubular standoff 17 for reference, a pin matrix support 19, flat clear display 13 and spring 23 shown in FIG. 2 in an extremely compressed state. To the right are seen a series of pins 61 with their respective heads 63 captured between the pin matrix support 19 and the flat clear display 13. The cam member 31 is seen to be a combination of an oblong cam 71 and a more than half cam 73 mounted on a common cam shaft 75.

The oblong cam 71 has a greater radial length and a shorter number of radial degrees of travel and is made to perform a maximum push against the pin matrix support 19, and this is shown in FIG. 2. The ends of the oblong cam 71 are rounded. The half cam 73 has a flat portion 77 and a radiused portion 79. Where a continuous drive motor is used, the travel along the periphery of the radiused portion 79 will represent a state where the chronometer 11 is in a quiescent state illustrating the time, and this will be illustrated in FIG. 4. The radiused portion 79 can be made to have a non-constant main extent in order to cause the expressed symbol to fade. Thus, the length of the half cam 73 could be gradually increased to match the outer extent of the oblong long cam 71 which would cause the erasure of the expression of the symbols to occur over a long period to cause the expressed symbol to, in effect, fade. Where a symbol or protruding number 51 was available for a long amount of time in a non moving state, the expression of the protruding number or symbol 51 could also be made to express slowly over time. The bearing by the flat portion 77, which coincidentally coincides with the flat side of the oblong cam 71, provides a very brief time for enabling maximum travel of the pin matrix support 19 away from display 13, and this will be shown in FIG. 3. Schematically represented in FIG. 2 is the belt 49 with its protruding symbol or number 51. This is the three dimensional object having a displacement image which the pins 61 will pick up through differential axial displacement when brought back towards the belt 49. Again, in FIG. 2, the maximum extent of bearing by the oblong cap 71 against the pin matrix support 19 is shown and in which each of the pins 61 are forced by the flat clear display 13 to be loaded to a maximum rear extent within the pin matrix support 19. This maximum extent occurs only briefly.

Figure 3:
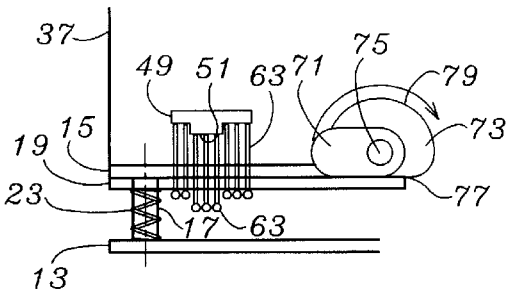
FIG. 3 is a flat cam position which allows the pin matrix to travel with the pins back to the physical shape to be picked up.

Referring to FIG. 3, the maximum rearward travel of the pin matrix support 19 with the pins sliding as in a manner as frictionless as possible through the pin hole array 15 enables certain of the pins 63 to engage the protruding numbers 51 to thus be pushed outwardly forward of the pin matrix support 19 to transmit the image of the protruding number 51 contacted by the end of the pins 61 for display through the flat clear display 13 which may be a plexiglass window, or even a glass window for superior resistance to any abrasion from the pin heads 63. In this position the spring 23 is fully extended, the pin matrix support 19 is brought adjacent or at least closer to the pin hole array 15, and certain of the pin heads 63 are seen as protruding due to the engagement of the pin tips with the protruding numbers 51.

Figure 4:
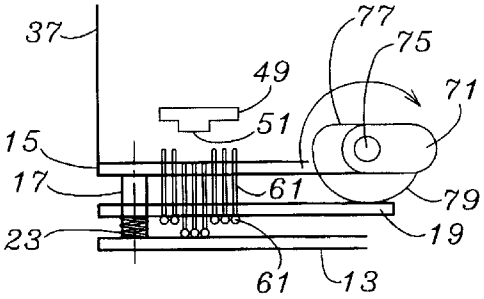
FIG. 4 is a return to normal display position.

The position shown in FIG. 4 is the position which the chronometer 11 occupies most of the time, typically about fifty five seconds each minute, and in which position the time is visible as seen recorded by differential displacement of the pins 61. After the cycle of FIG. 4, the cycle is repeated in accord with that shown in FIG. 2, then FIG. 3 and back to FIG. 4 again.

Figure 5:
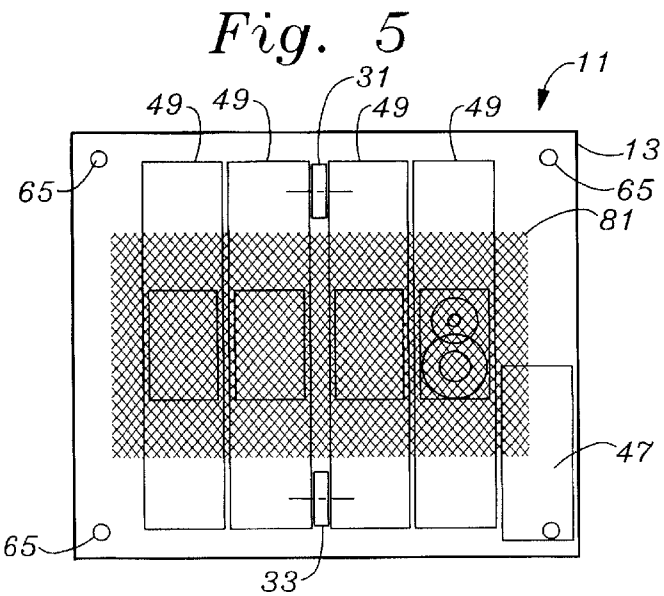
FIG. 5 is a front view of the chronometer seen in FIGS. 1–4.

Referring to FIG. 5, a frontal schematic view of the chronometer 11 is shown in less detail, but indicating the positioning of the cam members 31 and 33, the belts 49, a pin head area 81 and illustrating the expression of one symbol, the number "8" through the pin head area 81.

Figure 6:
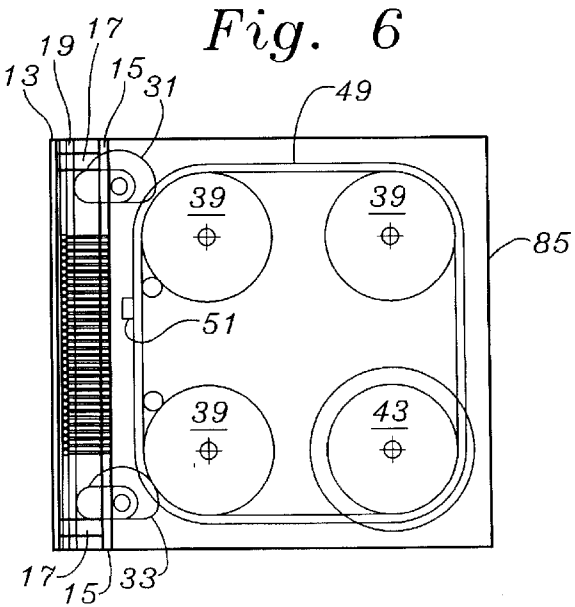
FIG. 6 is a side view of the chronometer seen in FIGS. 1–5.

Referring to FIG. 6 a side view of the chronometer seen in FIGS. 1–5 shows the orientation of the belts 49, cam member 31 and 33, roller drum supports 39, sprocket 43, all encased within covering box 57.

Figure 7:
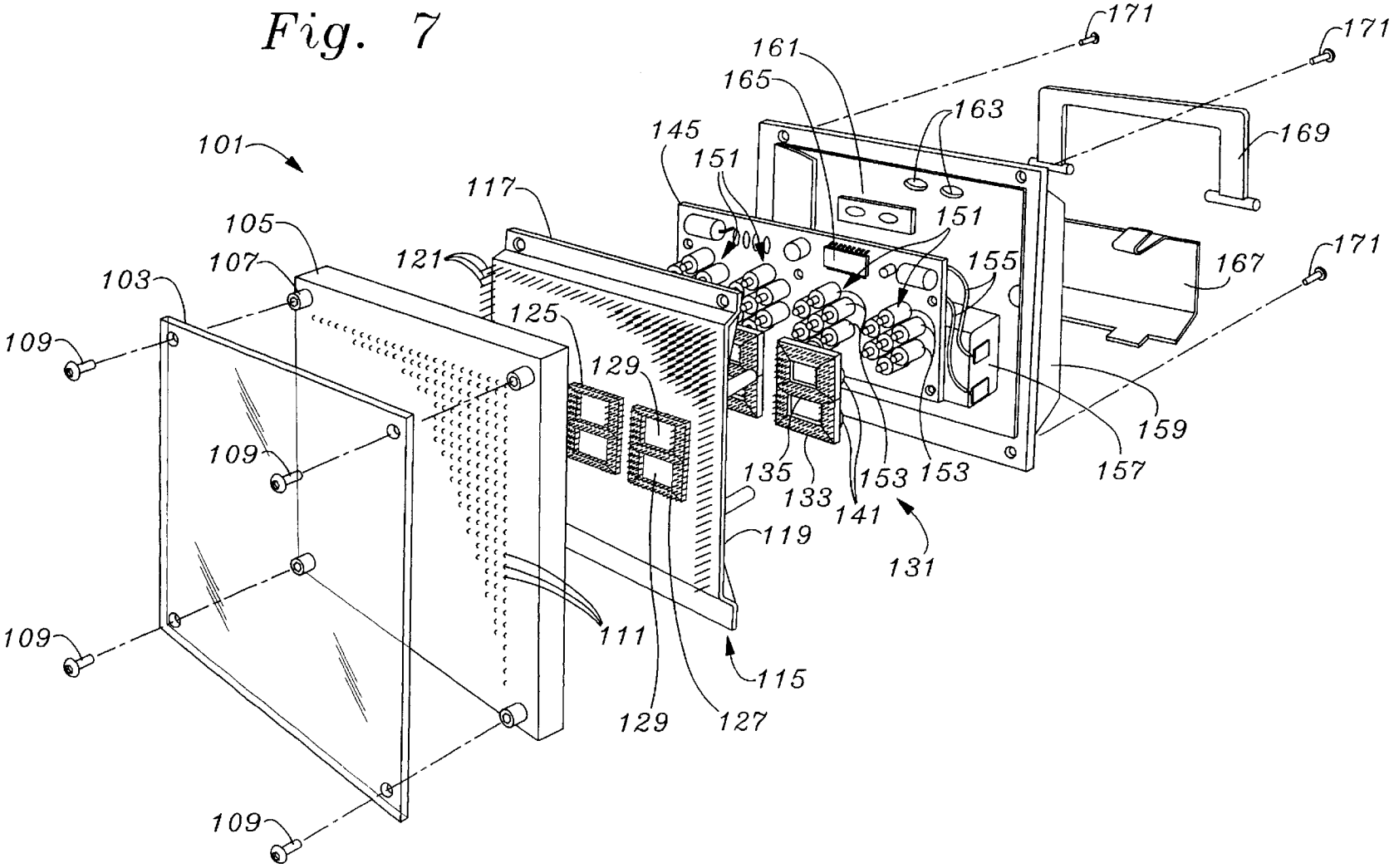
FIG. 7 is a perspective view of one realization of a further embodiment seen as a pin chronometer powered by solenoids.

Referring to FIG. 7, a second embodiment of a pin display is seen as a display chronometer 101. A flat clear display 103 is located in front of and spaced apart from a decorative pin hole array 105 using four tubular standoffs 107. The clear display 103 is held in by threaded members 109. Pin hole array 105 includes an array of apertures 111.

Behind the decorative pin hole array 105 is a fixed pin array structure 115 including a bracket 117 having a forward main plate 119 having an array of fixed pins 121. At the middle portion of the main plate 119, a segment in the shape of multiple numbers of "8" are seen with either holes 125 or whole missing sections 127.

In general, the nature of the holes 125 or whole missing sections 127 will not be observable through the flat clear display 103 because the holes 111 of the decorative pin hole array 105 visually obscure anything behind the decorative pin hole array 105. The pins 121 shown at the front of the fixed pin structure 115 are shown to a limited extent so-that the nature of either the holes 125 or missing sections 127 can be seen. Missing sections 127 leave two rectangular sections of forwardly projecting pins 129. Other pins will be brought from behind the fixed pin array structure 115 to enable a complete and even array of pins to project forward of the fixed pin array structure 115.

The pins which will project from behind either the holes 125 or missing sections 127 are moveable into and out of position, and depending on their length can typically be moved from a first position, where they are typically even with the pins 121, to a second position where they are uneven with the pins 121.

Where the pins utilizing the holes 125 or missing sections 127 are especially long, the second position of un-evenness will be a position where they are forward of the pins 121. Where the pins utilizing the holes 125 or missing sections 127 are short, the second position of un-evenness will be a position where they are rearward or more depressed than the pins 121. As such, an indicated sign will be in the first case a protrusion or projection, and in the second case a shadow or depression indication.

To the rear of the fixed pin array structure 115 and shown suspended in air are sets of pin supports 131 which form an "8" shape. Pin supports 131 are made up of pin support segments 133 and a middle pin support segment 135. The pin support segments 133 are generally trapezoidally shaped while the middle pin support segment is generally long with angled ends.

Also seen, but barely are plates 141 which lie behind and support the pin support segments 133 and 135. Behind the plates 141 is a circuit board 145. There are four clusters 151 of solenoids 153, which are preferably latched solenoids which work mechanically like a ball point pen mechanism. One actuation pushes the pins forward and a second actuation causes the pins to spring back. This is done for simplicity of control protocol, but any sort of control can be used, either more complex or more simple than the solenoids 153.

The circuit board 145 is shown as acting to support other circuitry as well as to support the solenoids 153. Power lines 155 are seen as connecting a battery sub-housing 157 of a main rear housing 159 to the circuit board 145. Main rear housing 159 can also house a transformer or other power conversion electronics where it is desired to plug the display chronometer 101 into the main house current system. In the alternative, the main rear housing 159 may have a direct current power jack in order to operate from a supplied wall mount transformer or the like.

A button set 161 is also connected to the circuit board 145 and may act through apertures 163 in the rear housing 159 to enable the user to set the current time. The button set 161 is also connected to a controller chip 165. Controller chip 165 can receive time sets from the user through the button set 161 and is controllably connected to the solenoids 153.

It has been stated that the solenoids 153 are preferably latched solenoids, operating such that one actuation pushes the pins forward and a second actuation causes the pins to spring back. Consequently the solenoids may either be fitted with a reset connection or in the alternative the user may have the ability to go into a reset mode where the button set 161 is used to synchronize the solenoids 153 for any out of phase timing inadvertently developed by technical problems.

Such technical problems may include insufficient battery power. There may be enough battery power to power the chip 165 but not enough to sufficiently power all of the solenoids 153. In this case, the solenoids 153 may fall out of sequence and need to be re-set.

Further to the rear of the rear housing 159 are seen a battery sub-housing 157 cover 167 and a carry handle 169. A series of four threaded members or rivets 171 are seen connecting the rear housing 159, fixed pin array structure 115, and decorative pin hole array 105 together.

Figure 8:
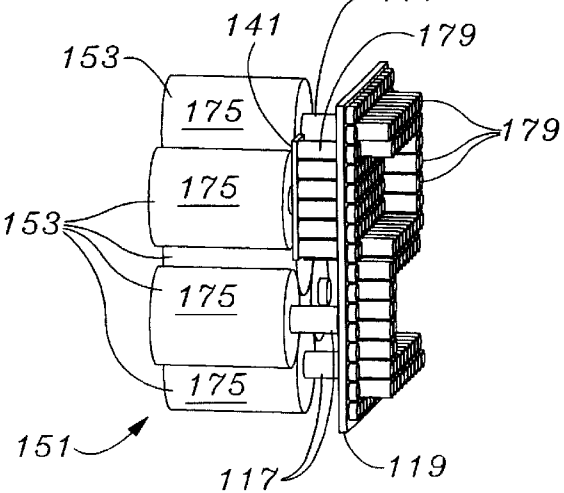
FIG. 8 is a side perspective view of a single cluster of solenoids seen in FIG. 7 and two examples positions achievable by pin support segments.

Referring to FIG. 8, a side perspective view illustrates a cluster 151 of solenoids 153. Each solenoid 153 includes a housing 175 and an actuator 177. As can be seen, the actuators 177 may be connected to the plates 141. Each of the plates 141 supports a series of actuatable pins 179.

The actuatable pins 179 are shown as extending through the forward main plate 119. The main plate 119 is shown with the array of fixed pins 121 removed in order to more clearly show the action. The number "2" is being displayed by the actuatable pins. As can be seen an upper row of pin support segments 133 supported by a plate 141 (not seen) are actuated to a forward position exposing the actuator 177.

The vertical pin support segments 133 between the upper left end of the "2" and the bottom vertical section of that displayed numeral are in the retracted position showing only a very abbreviated section of its actuator 177, but also showing its plate 141 at a rearward position such that the rearward ends of the actuatable pins 179 are exposed behind main plate 119. Enough of these rearward positioned pins are located forward of the main plate 119 that they do not fall out of their alignment with the main plate 119.

Figure 9:
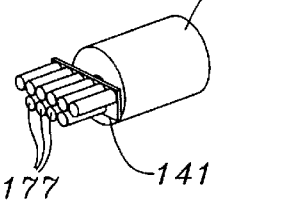
FIG. 9 is an isolated perspective view of a single solenoid and connector plate supporting an actuatable group of pins.

Referring to FIG. 9, a single operating component set for operating a single pin support segment 133 is shown. The pins 177 which fit through the pin support segment 133 are shown attached to the plate 141. The plate 141 is shown in close proximity to the housing 175 such that the actuator 177 is not seen in FIG. 9.

Figure 10:
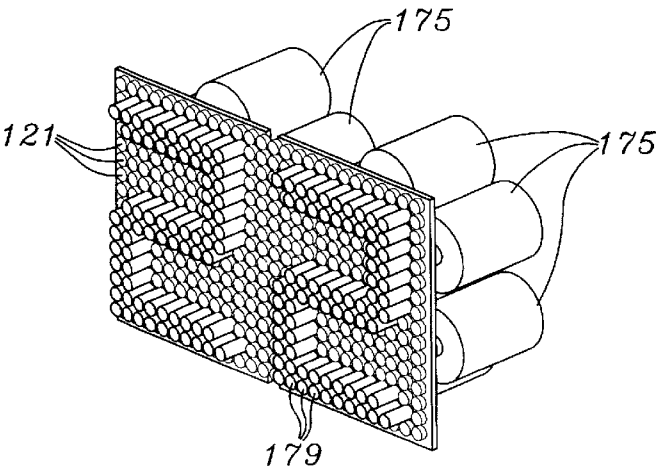
FIG. 10 is a perspective view of two clusters of solenoids operating through a fixed pin array structure to express the number "22" by forward movement of actuatable pins.

Referring to FIG. 10, an example of expression through actuatable pins 179 is shown. The "22" expressed is accomplished through the forward position assumed by the actuatable pins 179. The surrounding array of fixed pins are shown as very short, only for the ability to illustrate the difference in extension of the actuatable pins 179.

Figure 11:
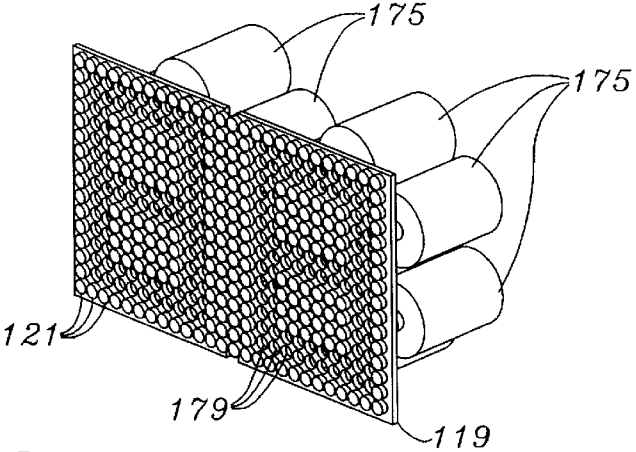
FIG. 11 is a perspective view of two clusters of solenoids operating through a fixed pin array structure to express the number "88" by rearward movement of actuatable pins.

Referring to FIG. 11, a different example of expression through actuatable pins 179 is shown. The "88" expressed is accomplished through the rearward position assumed by withdrawal of the actuatable pins 179. Again, the surrounding array of fixed pins are shown as very short, only for the ability to illustrate the difference in extension of the actuatable pins 179.

While the present invention has been described in terms of a chronometer utilizing axial pin movement expression, and more particularly to particular structures which utilize a set and re-set mechanism to track physical protrusions through axial displacement of a pin matrix.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A display device comprising:

a pin matrix having a plurality of parallel bores for supporting a plurality of pins mounted to slide within said bores;

a plurality of pins each said pin associated with and within and slidably translatable within said plurality of bores;

a reset surface toward which said pin matrix can be approachably moved to align an axial depth of said plurality of pins with respect to said pin matrix;

a moveable belt having protruding symbols, and said pin matrix also translatable to engage a subset of said plurality of pins to contact at least one of said protruding symbols to enable subset of said plurality of pins to become axially displaced in congruence with said protruding symbol;

mechanical means for moving said pin matrix in order to periodically re-align said plurality of pins and to periodically engaged said subset of said plurality of pins against said at least one of said protruding symbols;

mechanical means for driving said moveable belt to change a position of said at least one of said protruding symbols, in order to enable expression of said at least one of said protruding symbols upon said periodic re-aligning of said plurality of pins and periodic engagement of a differently located subset of said plurality of pins against said at least one of said protruding symbols.

2. The display device as recited in claim 1 and wherein said moveable belt having protruding symbols is set to advance at a rate proportional to the passage of time and wherein said at least one of said protruding symbols are indicative of such passage of time.

3. The display device as recited in claim 1 wherein said mechanical means for moving said pin matrix in order to periodically re-align said plurality of pins and to periodically engage said subset of said plurality of pins against said at least one of said protruding symbols includes a cam.

4. The display device as recited in claim 1 and wherein said reset surface is a flat clear display.

5. A display device comprising:

a pin matrix support having a plurality of parallel bores for slidably supporting a plurality of pins through said parallel bores;

a first plurality of fixed pins supported through said pin matrix support, each said pin associated with and within and slidably translatable within said plurality of bores;

a second plurality of actuatable pins slidably supported through said pin matrix support, said second plurality of actuatable pins divided into groups of at least two independently actuatable pin support segments;

a plurality of solenoids, each solenoid having a housing and an actuator mechanically linked to one of said independently actuatable pin support segments, whereby actuation of any one of said plurality of solenoids will cause at least one of said second plurality of actuatable pins to move to at least one of a position in advance of said first plurality of fixed pins, a position rearward of said first plurality of fixed pins, and a position even with said first plurality of fixed pins.

6. The display device as recited in claim 5 and wherein one of said at least two independently actuatable pin support segments formed by a plate attached to at least two of said second plurality of actuatable pins.

7. The display device as recited in claim 5 and wherein said solenoids include at least one solenoid which is a latched solenoids operating such that one actuation pushes one of said independently actuatable pin support segments to a first position and a second actuation pushes one of said independently actuatable pin support segments to a second position.

8. The display device as recited in claim 7 wherein said second position is a starting position from which said one actuation pushes one of said independently actuatable pin support segments to a first position.

9. The display device as recited in claim 5 and wherein said first plurality of fixed pins are supported by a main pin support plate adjacent said pin matrix support.

10. The display device as recited in claim 5 and further comprising a controller, controllably connected to said plurality of solenoids, to selectively control each of said groups of at least two independently actuatable pin support segments.

11. The display device as recited in claim 10 wherein said controller to selectively controls each of said groups of at least two independently actuatable pin support segments to display symbols indicative of a passage of time.

* * * * *